United States Patent [19]

Rebman

[11] Patent Number: 4,772,014

[45] Date of Patent: Sep. 20, 1988

[54] PHYSICAL REHABILITATION PLATFORM

[76] Inventor: Lester W. Rebman, 235 Palm Ave., Rockford, Ill. 61107

[21] Appl. No.: 890,929

[22] Filed: Jul. 31, 1986

[51] Int. Cl.[4] ..... A63B 1/00; A63B 5/00

[52] U.S. Cl. ..... 272/93; 272/70; 272/65

[58] Field of Search ..... 272/93, 1 R, 70, 109, 272/65, DIG. 9, 100, 101, 66; 128/25 R, 25 B, 68, 69; 5/417, 420, 474, 481; 434/247, 255; 297/202; 182/137-139

[56] References Cited

U.S. PATENT DOCUMENTS

| | | | |
|---|---|---|---|
| 195,052 | 9/1877 | Shishmanian | 182/137 |
| 828,221 | 8/1906 | Langel . | |
| 1,780,479 | 11/1930 | Griffith . | |
| 1,801,769 | 4/1931 | Gartner . | |
| 1,963,903 | 6/1934 | Hiss | 128/25 |
| 2,041,693 | 5/1936 | Boltz et al. | 128/25 |
| 2,206,902 | 7/1940 | Kost | 128/25 |
| 3,100,483 | 8/1963 | Altmeyer et al. | 128/25 |
| 3,434,715 | 3/1969 | Brantingham et al. | 5/417 |
| 3,634,895 | 1/1972 | Childers | 272/DIG. 9 |
| 3,737,161 | 6/1973 | Taylor et al. | 272/1 R |
| 3,765,407 | 10/1973 | Prince | 128/33 |
| 3,789,836 | 2/1974 | Girten | 128/25 |
| 4,073,490 | 2/1978 | Feather | 272/70 |
| 4,077,623 | 3/1978 | Clausell | 272/65 |
| 4,474,369 | 10/1984 | Gordon | 272/100 |

FOREIGN PATENT DOCUMENTS

| | | | |
|---|---|---|---|
| 1082170 | 7/1958 | Fed. Rep. of Germany | 272/109 |
| 2466999 | 5/1981 | France | 272/101 |

*Primary Examiner*—Richard J. Apley
*Assistant Examiner*—S. R. Crow
*Attorney, Agent, or Firm*—Leydig, Voit & Mayer

[57] ABSTRACT

The platform, while having many uses, is particularly valuable in assisting a physical therapist in training a patient to properly walk or run following an injury or debilitation. The platform consists of four outer trapezoidal panels sloped at an angle of about ten degrees and further comprises four inner triangular panels sloped at a smaller angle. A patient steps or bounces at various angles on the panels while being tethered by an elastic cord and, in the process, learns how to compensate for ankle or knee instability, for poor weight shift or for poor accommodation to uneven terrain.

9 Claims, 1 Drawing Sheet

PHYSICAL REHABILITATION PLATFORM

BACKGROUND OF THE INVENTION

This invention relates in general to physical rehabilitation and, more particularly, to rehabilitation of a person's ankle, knee or hip following injury or debilitation. The invention also relates to rehabilitation to improve impaired balance, poor accommodation to uneven terrain and poor weight shifting as well as to achieve strengthening of the lower body extremities.

SUMMARY OF THE INVENTION

The general aim of the present invention is to provide a new and improved physical rehabilitation platform which may be used by physical therapists and the like to help teach a patient to improve post injury joint stability, protective reflexes, balance and strength.

A more detailed object is to achieve the foregoing by providing a platform having multiple panels which are uniquely inclined to allow the patient to learn to compensate for a variety of stresses which may be imposed upon the lower body extremities during either normal activity or athletic activity.

Still another object is to provide a novel method of physical rehabilitation and exercise which employs the platform in conjunction with an elastic tether to promote proper walking, running, jumping and balancing at different levels of challenge depending upon the tension in the tether and the particular inclined platform area which is used.

The invention also resides in the novel shape and arrangement of the inclined panels of the platform.

These and other objects and advantages of the invention will become more apparent from the following detailed description when taken in conjunction with the accompanying drawings.

DETAILED DESCRIPTION OF THE PREFERRED EMBODIMENT

The present invention contemplates the provision of a multi-angled platform 10 which may be used to assist a physical therapist in training a patient to walk or run properly following an injury or debilitation. The platform is particularly characterized by its unique shape which enables the patient to perform a multitude of functional exercises at various challenge levels.

More specifically, the platform 10 is solid and is of sufficient strength to support several times the weight of an adult person. Herein, the platform is made of a strong but light weight material such as reinforced fiberglass.

The platform 10 preferably is square in outline when viewed from the top and is defined in part by four vertical side walls 11 disposed at right angles relative to one another and each having a length of about four feet and a height of about five inches.

Figure 1:
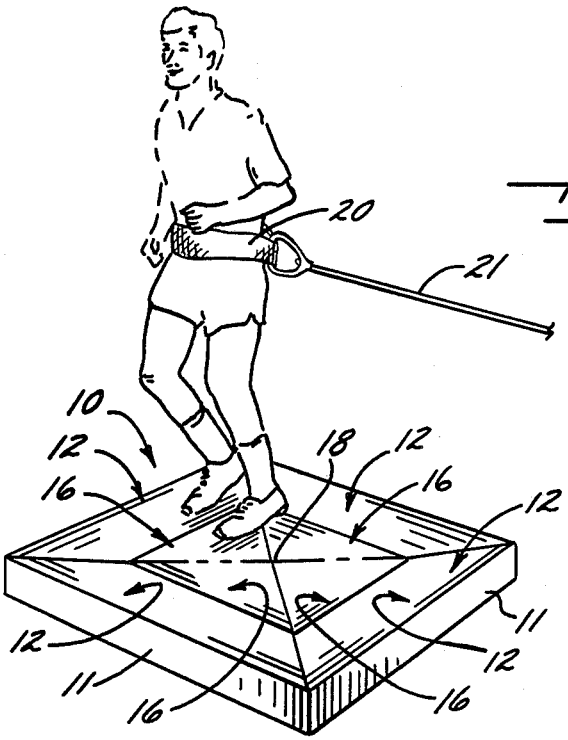
FIG. 1 is a perspective view of a new and improved physical rehabilitation platform incorporating the unique features of the present invention and shows one typical use of the platform by a patient.
Figure 2:
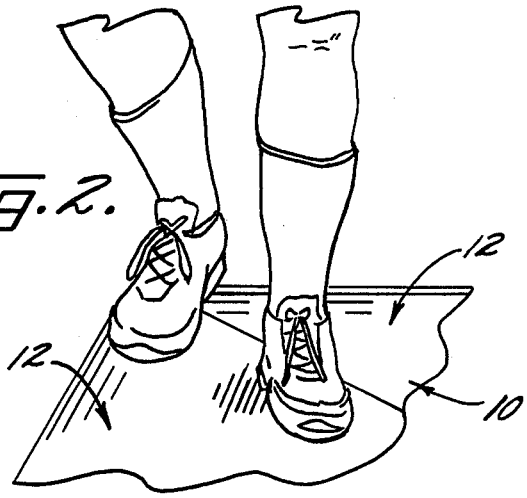
FIGS. 2 and 3 are enlarged perspective views of a portion of the platform illustrated in FIG. 1 and show two other typical uses of the platform.
Figure 3:
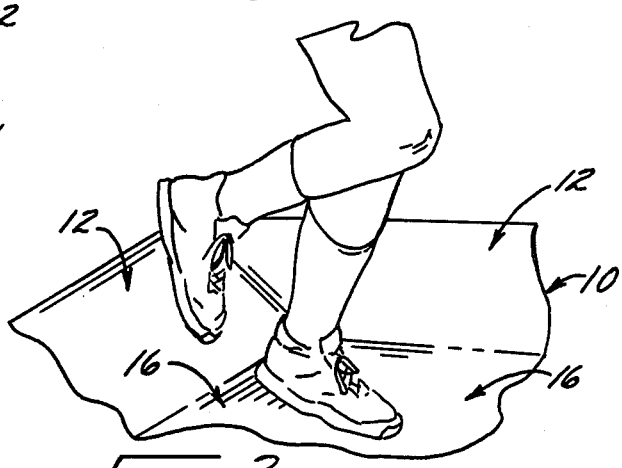
Figure 4:
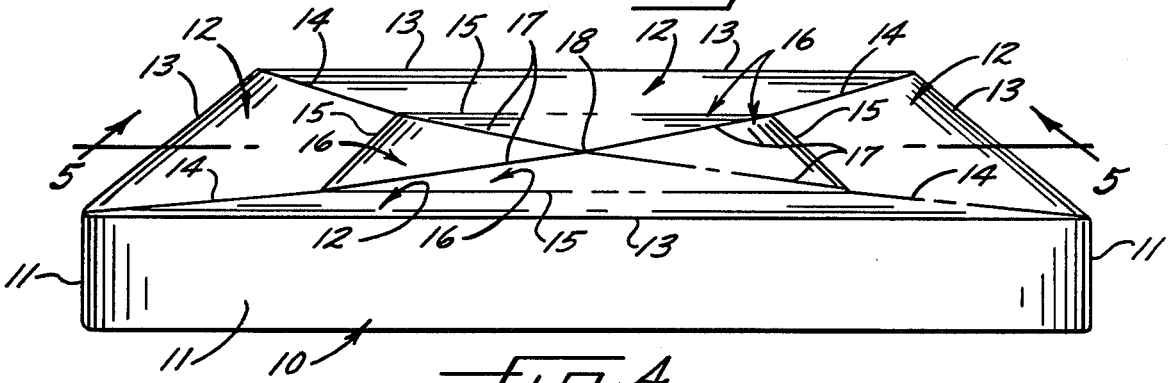
FIG. 4 is an enlarged perspective view of the platform of FIG. 1 as seen from a different angle.
Figure 5:
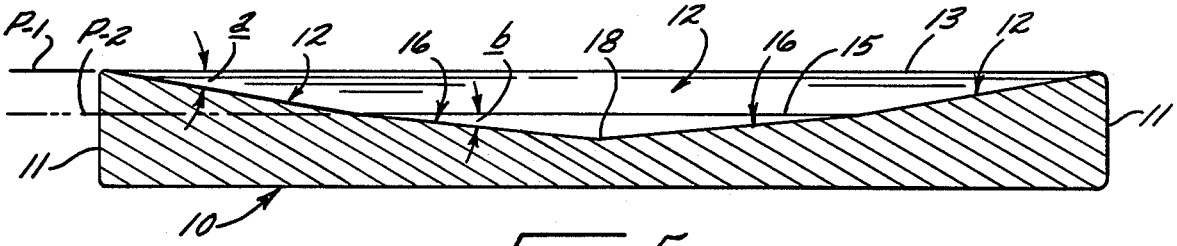
FIG. 5 is a cross section taken along the line 5—5 of FIG. 4.

As shown in FIG. 5, the upper margins of the four side walls 11 lie in a horizontal plane P-1. In keeping with the invention, the platform 10 includes four upwardly facing top panels 12 of identical polygonal shape and arranged relative to one another such that the outermost margin of each panel defines one side of a square disposed within the plane P-1. While the panels 12 could be triangular, herein each panel is shaped as a trapezoid. Each trapezoid includes a long base 13 (FIG. 4) extending along and co-extensive with the square within the plane P-1 and each includes two sides 14 extending along first and second diagonals of the square within the confines of the square. Adjacent sides 14 of adjacent trapezoids are co-extensive with one another. Each panel is inclined at a predetermined angle a (FIG. 5) relative to the plane P-1 and slopes downwardly upon progressing toward the center of the platform 10. In this particular instance, the angle a is in the neighborhood of ten degrees, each panel 12 being inclined at the same angle.

Further in carrying out the invention, the short bases 15 (FIG. 4) of the trapezoidal panels 12 define a second square lying in a lower horizontal plane P-2 (FIG. 5) in the center portion of the platform 10, the platform including four additional upwardly facing top panels 16 which are of identical triangular shape. Each of the triangular panels 16 includes a base extending along and co-extensive with a short base 15 of a panel 12 and further includes first and second sides 17 (FIG. 4) extending along first and second diagonals of the two squares and disposed within the confines of the second or lower square. Adjacent sides 17 of adjacent triangular panels are co-extensive with one another, and all of the sides 17 meet at a common point 18 at the geometric center of the platform 10.

The triangular panels 16 are inclined equally relative to the plane P-2 and also slope downwardly upon progressing toward the center 18 of the platform 10 but at a smaller acute angle b (FIG. 5) than the angle a of inclination of the trapezoidal panels 12. The angle b preferably is six degrees.

With the foregoing arrangement, a person with a belt 20 around his waist may stand on the platform 10 and may be attached to a fixed and solid object (e.g., a hook on a wall) by a tether cord 21 made of resiliently yieldable material such as strong elastic. Under the guidance of the physical therapist, the person then steps, bounces or dances on the panels 12 and/or the panels 16 while keeping tension on the cord 21. The cord tends to pull the patient sidewise and forces the person to apply pressure to his legs, ankles and feet in order to remain in position on the panels or panel. One of the panels 12 causes one or both of the patient's feet to tilt in one direction to apply sidewise force to the ankle or ankles while the opposite panel 12 tilts the foot or feet reversely to apply an oppositely directed sidewise force to the ankle or ankles. By shifting the position of the outer foot upwardly and downwardly on a panel 12, the stress applied to the outboard ankle is increased and decreased, respectively. By using the center panels 16 of lesser slope, even less stress is applied and thus the panels 16 are used for initial therapy or with patients with more serious debilitation. By performing various exercises and manuevers on the inclined panels 12 and 16, the patient learns to compensate for a variety of stresses so as to improve post-injury joint instability, protective reflexes, balance and strength. The platform is effective in the treatment of ankle and knee instability and injury, hip problems and poor accommodation to uneven terrain as well as serving to facilitate an overall exercising program for the lower body extremity.

The platform 10 will find use in clinics, hospitals, nursing homes, training rooms and health clubs as well as at home. While the platform 10 has been disclosed specifically as comprising a set of trapezoidal panels 12 and an additional set of triangular panels 16, the platform could be formed simply by four triangular panels of appropriate size and angle and positioned to meet at a common point at the center of the platform. Such a platform, however, would lack the multi-angled effect of the specific platform 10 which has been shown and would not enable the patient to perform at as many challenge levels.

I claim:

1. A physical rehabilitation platform having four upwardly facing flat top panels of trapezoidal shape and arranged relative to one another such that the long base of each panel defines one side of a rectangle disposed in a horizontal plane and extending around the panels, said panels each having first and second sides extending along first and second diagonals of the rectangle within the confines of the rectangle, said panels all being inclined relative to said plane and sloping downwardly upon progressing toward the center of said platform, the short bases of said panels defining a second rectangle in the center portion of said platform, said platform having four additional upwardly facing panels of triangular shape, each of said triangular panels having a base extending along and co-extensive with one side of said second rectangle and each having first and second sides extending along first and second diagonals of the second rectangle, within the confines of the second rectangle, all of said triangular panels also being inclined relative to said plane and sloping downwardly upon progressing toward the center of said platform but at a smaller acute angle than said trapezoidal panels, the center portion of said platform being solid and being of sufficient strength to support several times the weight of an adult person.

2. A physical rehabilitation platform as defined in claim 1 in which all of said trapezoidal panels are inclined downwardly at equal angles relative to said plane.

3. A physical rehabilitation platform as defined in claim 2 in which said first rectangle is a square and in which said trapezoidal panels are all shaped as identical trapezoids.

4. A physical rehabilitation platform as defined in claim 2 in which all of said triangular panels are inclined downwardly at equal angles relative to said plane.

5. A physical rehabilitation platform as defined in claim 4 in which said second rectangle is a square and in which said triangular panels are all shaped as identical triangles.

6. A physical rehibilitation platform as defined in claim 5 in which apices of all of said triangular panels meet at a point in the center of said platform.

7. A physical rehabilitation platform comprising four upright side walls disposed at right angles to one another and defining a square, four identical upwardly facing top panels shaped as trapezoids, each of said top panels having a long base joined to and co-extensive with the upper margin of a side wall and having first and second sides extending along first and second diagonals of said square within the confines of the square, said panels being inclined downwardly at a predetermined angle from the upper margins of said side walls, the panels joined to opposing side walls converging symmetrically toward one another upon progressing downwardly, said platform further comprising four identical upwardly facing top panels of triangular shape and having bases joined to the short bases of said trapezoidal panels, said triangular panels being inclined downwardly at different angles than said trapezoidal panels, the triangular panels joined to opposing trapezoidal panels converging symmetrically toward one another upon progressing downwardly, the center portion of said platform being solid and being of sufficient strength to support several times the weight of an adult person.

8. A physical rehabilitation platform comprising four upright side walls disposed at right angles to one another and defining a first square, four upwardly facing and identical trapezoidal top panels, said top panels having long bases joined to and co-extensive with the upper margins of said side walls and having short bases defining a second square centered within said first square, each of said panels having first and second sides extending along first and second diagonals of said first square, said panels being inclined at equal acute angles relative to a horizontal plane and all sloping downwardly upon progressing toward the center of said platform, said platform also having four upwardly facing and identical polygonal panels, said polygonal panels having bases coextensive with the short bases of said trapezoidal panels and each having first and second sides extending along first and second sides of said second square within the confines of said second square, said polygonal panels being inclined at equal acute angles relative to said horizontal plane and all sloping downwardly upon progressing toward the center of said platform, the acute angle of inclination of each polygonal panel being less than the acute angle of inclination of each trapezoidal panel.

9. A physical rehabilitation platform as defined in claim 8 in which said polygonal panels are triangular and have apices which meet at a point in the center of said platform.

* * * * *